US007255644B2

(12) United States Patent
Duhamel

(10) Patent No.: US 7,255,644 B2
(45) Date of Patent: Aug. 14, 2007

(54) JACKPOT AWARDING SYSTEM

(75) Inventor: Gérald Duhamel, Drummondville (CA)

(73) Assignee: Labtronix Concept Inc., Drummondville, Quebec (CA)

( * ) Notice: Subject to any disclaimer, the term of this patent is extended or adjusted under 35 U.S.C. 154(b) by 586 days.

(21) Appl. No.: 10/203,650

(22) PCT Filed: Feb. 23, 2001

(86) PCT No.: PCT/CA01/00223

§ 371 (c)(1),
(2), (4) Date: Nov. 19, 2002

(87) PCT Pub. No.: WO01/63574

PCT Pub. Date: Aug. 30, 2001

(65) Prior Publication Data

US 2003/0146574 A1 Aug. 7, 2003

(51) Int. Cl.
*A63B 13/00* (2006.01)

(52) U.S. Cl. ..... 463/25

(58) Field of Classification Search ..... 463/12, 463/13, 16–22, 25–28, 40–42
See application file for complete search history.

(56) References Cited

U.S. PATENT DOCUMENTS 4,926,327 A * 5/1990 Sidley ..... 463/13
5,007,641 A * 4/1991 Seidman ..... 463/17
5,035,422 A * 7/1991 Berman ..... 463/18
5,048,833 A * 9/1991 Lamle ..... 463/27
5,280,909 A * 1/1994 Tracy ..... 463/27
5,292,127 A * 3/1994 Kelly et al. ..... 273/118 A
5,472,194 A 12/1995 Breeding
5,542,669 A * 8/1996 Charron et al. ..... 463/13
5,882,260 A * 3/1999 Marks et al. ..... 463/13
6,007,424 A 12/1999 Evers et al.
6,033,307 A * 3/2000 Vancura ..... 463/20

(Continued)

FOREIGN PATENT DOCUMENTS

WO WO99 03078 1/1999

(Continued)

OTHER PUBLICATIONS

Schwartz, David, Steve Ryan, and Fred Wostbrock. "The Encyclopedia of TV Game Shows". 1999. Checkmark Books, pp. 176-180.*

*Primary Examiner*—John M. Hotaling, II
(74) *Attorney, Agent, or Firm*—Ogilvy Renault LLP

(57) ABSTRACT

The object of the present invention is a method of awarding prizes, also known as progressive jackpots, in association with a wagering game such as a Poker game. A particular application of this method is in association with a Poker game on an electronic gaming device. For awarding the progressive jackpot, players must accumulate in a counter a number of point corresponding exactly to one of the predetermined criteria. To obtain points, players have only to play the Poker game as on any other Poker machine. The points are added in the counter along with the winning outcomes in the game. A particular embodiment consists of awarding two kinds of points: win points and no-win points. With this embodiment, only win points are effective to win the progressive jackpot. The no-win points increase the counter values but can not lead to winning the jackpot.

17 Claims, 10 Drawing Sheets

U.S. PATENT DOCUMENTS 6,139,431 A * 10/2000 Walker et al. ..... 463/20
6,142,872 A * 11/2000 Walker et al. ..... 463/16
6,227,969 B1 * 5/2001 Yoseloff ..... 463/13
6,494,785 B1 * 12/2002 Gerrard et al. ..... 463/20

FOREIGN PATENT DOCUMENTS

WO WO99/03078 * 1/1999

* cited by examiner

JACKPOT AWARDING SYSTEM

FIELD OF THE INVENTION

The present invention relates to a method of calculating prizes to be awarded in a gaming device, as well as to a method of awarding prizes, also known as jackpots, in wagering games such as those played on casino tables or on electronic gaming devices.

BACKGROUND OF THE INVENTION

There are many kinds of video lotteries in commercial use. Gaming facility managers choose to operate particular kinds of games according to players' preferences and the current legislation. The kinds of games growing in popularity in the last decades are the ones played on electronic gaming devices comprising a video display. One example is Poker games played on electronic Poker machines.

One particular method used by gaming facility managers to attract players consists of offering big prizes also known as jackpots in these games. This method generally consists of awarding a progressive jackpot when a player yields a particularly rare winning combination. Furthermore, to increase the value of the progressive jackpot faster, a common technique is to link electronic gaming devices offering the same game on a network. Therefore, the value of the progressive jackpot grows in regards to the number of plays for the game on all the gaming devices of the network. Then, the progressive jackpot is awarded to the first electronic gaming device of the network yielding the winning combination.

With this method, gaming facility managers offer jackpots that can increase to very big values. Nevertheless, to obtain very big amounts, the winning combination must be very rare. Consequently, it is very rare for players to see someone win the jackpot. Furthermore, to increase the jackpot even faster, the network frequently links devices from different locations. Therefore, the jackpot is sometimes awarded while players are playing but in another location.

Additionally, when the jackpot is awarded, frequently players do not see why they should keep playing the game, and the electronic gaming devices stay relatively unused until the jackpot reaches once more an interesting value. Consequently, managers see their revenues decrease during this period.

To attract players, some games accumulate elements pertaining to the outcomes of the game. An example of this is slot machines with a feature presenting a climbing element. Depending on the final outcomes of the plays, the climber stays in position or climbs one, two or three steps. If the climber reaches the top of the mountain, the tower, or any element to climb in the game within a predetermined number of plays, the player is awarded a prize. In these games, whatever the number of plays needed to climb to the top within the predetermined number of plays, the prize is awarded. Furthermore, the climber can pass over the top without influencing the prize. Moreover, the result of this game depends only on the randomness of the game. Players have no control over the game. Even more, when the number of plays reaches the predetermined number, the climber returns to the bottom of the element to climb, the previous path done is erased. Therefore, this can frustrate players.

Another kind of game with accumulation features to attract players consists of accumulating a number of predetermined outcomes in the game to obtain a fever mode This method is widely used in 8liners slot machines and allows players to accumulate different outcomes simultaneously. Nevertheless, the outcomes do not increase the same counter. Therefore, there are different ways to reach the fever mode, but all depends on randomness. Players do not have control over the accumulation of these elements. Furthermore, players do not know the value of the fever mode; it varies from time to time.

Additionally, for both of above accumulation-based features, the features must be designed originally in the game, not implemented further in the life of the game. These elements are part of the game. They can not be implemented without changing the rules of the games.

Another widely used method by casino managers to attract players consists of awarding points redeemable to services offered by the casino. To acquire points, players must possess a VIP card on which points will be credited in regards to their plays. The number of points varies in regards to different characteristics of the plays: the amounts played, the games played, the moment played, etc. Nevertheless, to acquire an interesting number of points, players must play a lot of money. Consequently, this does not succeed in interesting players who do not want to bet too much during their time at the casino.

To maintain the interest in their games, another strategy of game designers is to create new games continuously presenting more innovative new bonuses, more high-quality graphics, more animations, more sounds, etc. Therefore, these features are there to create an atmosphere, a unique and interesting playing environment. However, as interesting as these elements are, they require time and money to develop. Furthermore, they require more and more powerful gaming devices to play them. Moreover, when players have seen all the possible bonuses in the game, they frequently lose interest for the game. Consequently, game designers continually need to develop new games presenting new bonuses, new graphics, new animations, . . .

The usual progressive jackpots need a network and several electronic gaming devices to increase the progressive jackpot to attractive value. Moreover, the players are interested by progressive jackpots only when the value of the progressive jackpot has already grown to an attractive amount. Therefore, the method of progressive jackpots does not succeed in attracting players to play on electronic gaming devices in all cases. The development of new games, new graphics, etc. by game designers succeeds in attracting players to play their game. Nevertheless, in the long run, it does not always succeed in keeping players playing their games. Players want games that they will not tire of in the long run. The best proof of that is the popularity of Poker games. Even if the game has existed for more than a century, Poker games are still very popular with players.

Therefore, none of the methods above offer a successful method of attracting players to play a game and to keep them playing the game long. However, the present invention offers a method of awarding a jackpot that will succeed in attracting players to play a game. The method will also succeed in having them keep on playing the game. Furthermore, the method allows implementation of jackpots in players' favorite games without changing the rules of the game. Therefore, it does not force players to try a new game for which they have primarily no particular interest. Further, the method allows awarding relatively frequent low prizes or very rare big prizes according to the criteria used to award the prizes. Furthermore, it offers all these advantages within simple rules and simple displays that will not bother players. Ultimately, the method gives to players a sense of control over their plays and their chances of winning the prize. With this sense of control, players can make intelligent decisions over their plays that will really affect their chances of winning the prize.

Furthermore, the method of awarding a jackpot of the present invention can be implemented on both stand alone electronic gaming devices and multiple electronic gaming devices linked by a network without influencing the interest generated by the method.

Finally, the method does not need additional power from electronic gaming devices. It can be implemented on most electronic gaming devices.

SUMMARY OF THE INVENTION

Accordingly, it is an object of the present invention to provide a new method of awarding progressive jackpots.

A further object is to give a sense of control to players over their chances of winning the jackpot. Furthermore, this sense of control must not only be an illusion but rather a reality depending totally on the player's strategy.

Another object is to offer a method of awarding a jackpot that can be implemented on both stand-alone electronic gaming devices and networks of electronic gaming devices. Furthermore, this method offers interesting jackpots for both environments.

Another object of the invention is to permit implementation of this method with the games players know best without changing the rules and basic strategies of the game. Therefore, players will not need to become familiar with new games, new rules, new strategies and new game environments.

An additional object is to offer a method that does not demand powerful electronic gaming devices caused by additional requirements. Therefore, gaming facility managers do not need to invest a lot of money in the electronic gaming devices to implement the method of awarding jackpots of the present invention.

According to the above objects, the invention provides a method of awarding progressive jackpots in regards to a wagering game. More precisely, this method is particularly dedicated to an application on electronic gaming devices.

The method consists of: 1) establishing a number of point awarding events in a wagering game, 2) associating points to each one of the point awarding events, 3) accumulating points along the way to the occurrence of the point awarding events in the game, and 4) rewarding players with a jackpot when the number of points accumulated are equal to a predetermined number of points.

The method comprises the underlying task of accumulating a percentage of the bets played in the wagering game into a progressive account, therefore increasing the account progressively along with the plays. Furthermore, the value of the account is dedicated to paying the amounts of the jackpots awarded when the jackpots are won. The value of the account decreases only when a player wins a jackpot in the game.

The method comprises in displaying information about the value of the jackpot, the number of points accumulated in the game, the criteria corresponding to the number of points players need to match to win a jackpot, and the number of points awarded in regards of the point awarding events.

This displayed information allows players to know without further research the requirements to win a jackpot.

Since the criteria to win a jackpot can be predetermined as difficult to get, the jackpots reach higher amounts, therefore making it interesting for players. Nevertheless, the criteria can be determined as easier, this way permitting players to win more frequently less important jackpots.

The jackpot can increase according to bets placed on a network of electronic gaming devices. Therefore, players on all the electronic gaming devices have the possibility of winning the jackpot. Moreover, with all players on the electronic gaming devices on the network trying to win the jackpots, they take part to something similar to a race in which the goal is not to cross the finish line first but to be the first at the finish line. Furthermore, players going beyond the finish line move even farther from a new finish line.

If the method is implemented on stand-alone devices, the goal of the player is not to finish first, but to be sure not to go beyond the finish line. Furthermore, this method gives to players an impression that the jackpot belongs to no one else but them. Therefore, the player will play on and on having the impression that the jackpot value comes from his previous bets, and will want to recover his money.

Since no high-quality graphics, animations, sounds need to be added to the game, and since no additional game interfaces are needed to implement the present method of awarding a jackpot, it does not require powerful electronic gaming devices to play it. More precisely, it does not require more powerful devices than those needed to play the game itself.

First, an appropriate embodiment of this method of awarding a jackpot is to offer a game wherein a random number of points is accumulated each time a winning event occurs in the game. Therefore, players know the number of points they need to win the jackpot without being able to effectively control their plays to get the exact number of points they need. A display showing the evolution of points accumulated informs players regarding the number of points needed to win, letting them calculate how far they are from winning the jackpot in terms of number of games. When players reach a number of points near to the one needed to win the jackpot, a feeling of suspense takes place.

A second embodiment similar to the one above consists of using distinct banks of predetermined points for each point awarding event, and to randomly pick one number from the corresponding bank of points when a point awarding event occurs in the game. Furthermore, a point awarding event having low probabilities of occurring will award less points in its corresponding bank, therefore making it hard to match the aimed number and win the jackpot.

Additionally, a third possible embodiment consists of giving a small number of points to point awarding events having low probabilities of occurring, and a bigger number of points to point awarding events that are easily achievable. Therefore, it is difficult for players to exactly match the aimed number permitting to win the jackpot. For example, a fixed number of points is easier to match with a series of 2, 3 and 5 points than with a series of 9, 11, and 12 points.

A fourth embodiment consists of having only part of the winning outcomes as point awarding events. It consists of determining the number of points awarded not only in regards to the point awarding event but also in regards to the element composing the point awarding event. Therefore, players can foresee the series of point awarding events they need to win the jackpot. They can play the following games in hope of obtaining the points needed and consequently win the jackpot. Nevertheless, since only part of the winning outcomes are point awarding events. And, since the number of points depends on the elements composing the point awarding event, it is difficult for players to match the number of points they need.

Furthermore, a possible addition to these embodiments can be to add or remove points in regards to losing games. Therefore, it would be even more difficult for players to foresee what it takes to win the jackpot due to the obligation takeoff taking into account the losing games.

A fifth embodiment of the method of awarding a jackpot consists of awarding two (2) different kinds of points; no-win points not effective even if the jackpot is matched, and win points effective to win the jackpot. To eliminate the possibility of easily foreseeing the following hands needed to win a jackpot, no-win points are gathered along with other points. Furthermore, no-win points awarded in regards to specific point awarding events are easier to obtain then win points. Moreover, no-win points and win points are gathered together. No-win points will not lead players to winning the jackpot. Consequently, jackpots can only be won when the last points gathered are win points, therefore rendering the jackpot harder to win.

An additional embodiment consists of implementing this method on a network of multiple electronic gaming devices the method consists of adding to a same meter all the points awarded to players and awarding the jackpot only to the player matching the aimed number of points. Therefore, it creates an interaction between players without changing the rules of the game.

The preferred application for the embodiments presented above is on an electronic Poker game. A percentage of the bets played in the Poker game is kept to increase the jackpot. Furthermore, a special display on the main screen display shows the increase in the number of points accumulated and the aimed number of points to match to win the jackpot.

BRIEF DESCRIPTION OF THE DRAWINGS

These and other features, aspects and advantages of the present invention will become more clearly understood with the following description and accompanying drawings, wherein.

DETAILED DESCRIPTION OF DIFFERENT EMBODIMENTS

The embodiments here are presented for illustration purposes only in regards to a Poker game. All the embodiments refer to the different rules and winning combinations of a standard Poker game with the lowest winning combination being a pair of jacks, rules widely known by players of electronic Poker games. Nevertheless, the method of awarding jackpots can be implemented to other kinds of games without departing from the scope of the present method. The method can be implemented on both strategy-based wagering games such as Poker games, and random-based wagering games such as electronic slot machines. The different embodiments presented hereafter are there for explanation purposes, and are not there to limit the scope of the present method of awarding jackpots.

Hereafter the explanations above, the first embodiment here consists of a Poker game played on an electronic gaming device. In the Poker game, when a final hand corresponding to a winning combination is yielded by a player, hereafter called point awarding event, the game adds to a meter a number of points randomly chosen by the electronic gaming device. Depending if the value of the meter resulting from the last addition of points matches an aimed number of points corresponding to a predetermined criterion, the jackpot is awarded.

Figure 1:
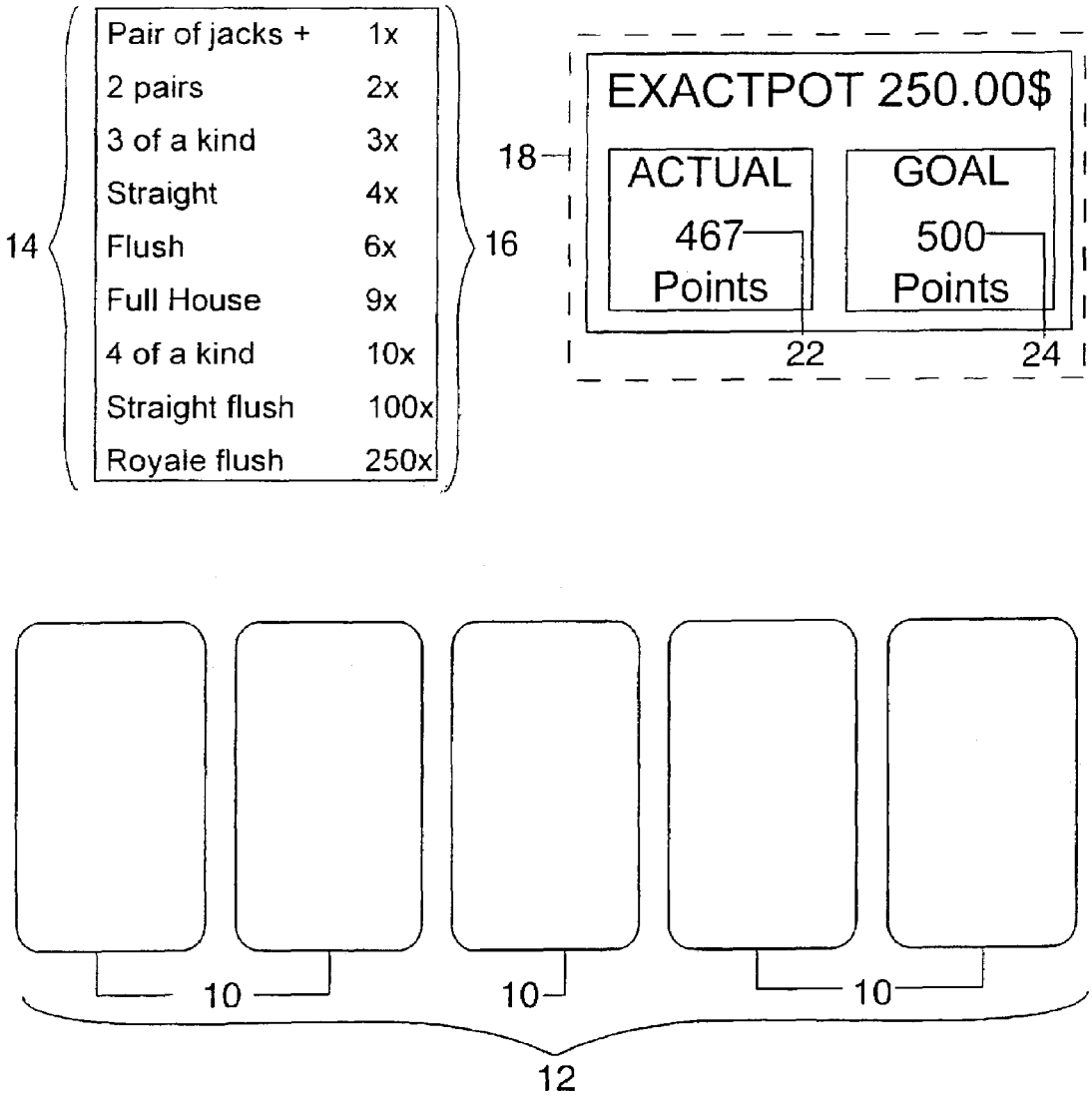
FIG. 1 is a play screen illustrating a Poker game according to the first embodiment.

The final screen according to the changes in the game interface on the electronic gaming devices is presented in FIG. 1. It shows a game interface for the major part perfectly similar to a regular Poker game display. It comprises the five (5) playing cards 10 composing the player's Poker hand 12, a list of the winning combinations 14 and the odds 16 determining the amount paid according to each winning combination 14. It also comprises new information in the screen interface 18 showing what players need to know in regards to winning the jackpots. This game interface 18 comprises in more details the jackpot value 20, the number of points accumulated 22 up to date corresponding to the meter value, and the number of points a player must match 24 to win the jackpot, i.e. the aimed number of points. This information 20, 22 and 24 are specific to awarding the jackpot and do not influence the rules of the game neither as the value 16 of the different winning combinations 14. Furthermore, this information 20, 22 and 24 are constantly updated to assure that players have all the information required to make intelligent decisions in regards to winning the jackpot. However, even if additional information 18 is displayed on the screen, the information of the game itself still has all the visibility required. Therefore, it is clear what is the primary goal of the game: the Poker game.

Figure 2:
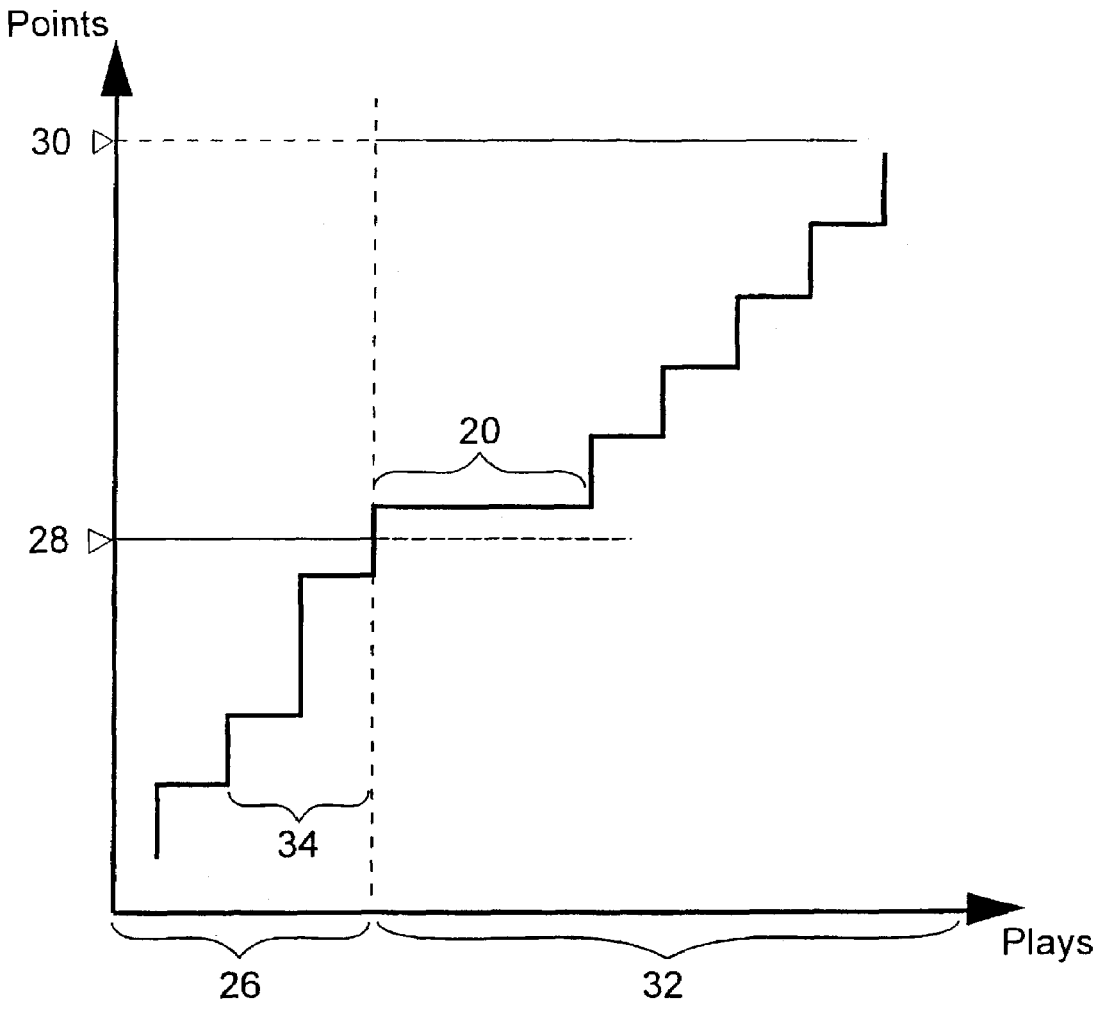
FIG. 2 is a schematic graphic showing the evolution of points within the Poker game of the first embodiment.

FIG. 2 presents in a graphical way the evolution of the number of points according to the plays in the game. Moreover, the graphic presents the evolution of the number of points in regards to the criterion aimed. The evolution of the points along with the plays shows that not every play produces an outcome having points, For example, the sequence of plays 26 shows numerous sequential plays without increasing the number of points of the player. Nevertheless, the sequence of plays 34 shows continuous evolution in the number of points, therefore shows that every outcome of the sequence 34 allow the game to award points to the player. More globally, the sequence of plays 26 corresponds to plays wherein the player's goal is to match the criterion 28 with his number of points. However, with the last play of the sequence 26, the player sees the number of points in the meter going beyond the criterion 28, therefore seeing his chance of winning the jackpot with this criterion ending. Therefore, the nearest criterion possible to match becomes criterion 30. To match this criterion, the player needs to acquire a lot of new points. Thus, the player's goal for the sequence of plays 32 is to win as well as he can do for each of the plays, and to match at the end of the sequence of plays 32 the criterion 30. Furthermore, if he goes beyond the criterion 30 without matching it, the player sees a new criterion becoming active on the screen of the Poker machine without, once again, winning the jackpot.

While playing, players see the meter value increasing closer to the aimed number of points. Therefore, players see the influence of their plays on the meter value in their evolution towards winning the jackpot. As the game advances, players will come closer and maybe go beyond the aimed number of points. When the aimed number of points is overshot, the aimed number of points is replaced by a new one requiring more points. Since the jackpot is only awarded if the value of the meter matches exactly the aimed number of points, going beyond presents no advantage for players. In the contrary, it forces players to accumulate an important number of new points to be close once again to the aimed number of points.

For example, TABLE 2 shows a series of hypothetical outcomes in a Poker game, their influence on the meter and on the chance of winning the progressive jackpot. For this example, the number of points is chosen randomly for each point awarding event into a ranger of numbers varying from 1 to 19. Therefore, the average value of the number of points increasing the meter value is 10 points.

In addition, the criteria schedule of TABLE 1 shows the awarded percentage of the progressive jackpot in regards to the different aimed number of points. This schedule permits to avoid awarding the whole jackpot at each win. Therefore, the result is to avoid frequent periods of jackpots at unattractive values. By keeping high jackpot values, it is easier to maintain player interest. The way that the criteria for winning a jackpot are defined for this example are by steps of 500 points with variable parts of the jackpot awarded when the accumulated points match one of the criteria. Steps of 2500 points divide possibilities to win the whole jackpot. With this criteria schedule, additionally with the hypothesis of a point awarding event occurring every 3 plays, it takes an average amount of 160 games for a player to increase the meter value of about 500 points.

TABLE 1

List of criteria to award the jackpot and percentage awarded

| Number of points | % of the jackpot awarded |
|---|---|
| 500 points | 40% |
| 1000 points | 20% |
| 1500 points | 50% |
| 2000 points | 25% |
| 2500 points | 100% |
| 3000 points | 40% |
| . . . | . . . |

TABLE 2

List of results for the first embodiment

| Outcomes | Number of points | Meter value | Win jackpot? |
|---|---|---|---|
| Pair of jacks | 7 points | 463 points | No |
| Loss | 0 points | 463 points | No |
| 3 of a kind | 13 points | 476 points | No |
| Pair of kings | 2 points | 478 points | No |
| Loss | 0 points | 478 points | No |
| 2 pairs | 12 points | 490 points | No |
| Pair of Queens | 19 points | 509 points | No (next at 1000 points) |

Figure 3:
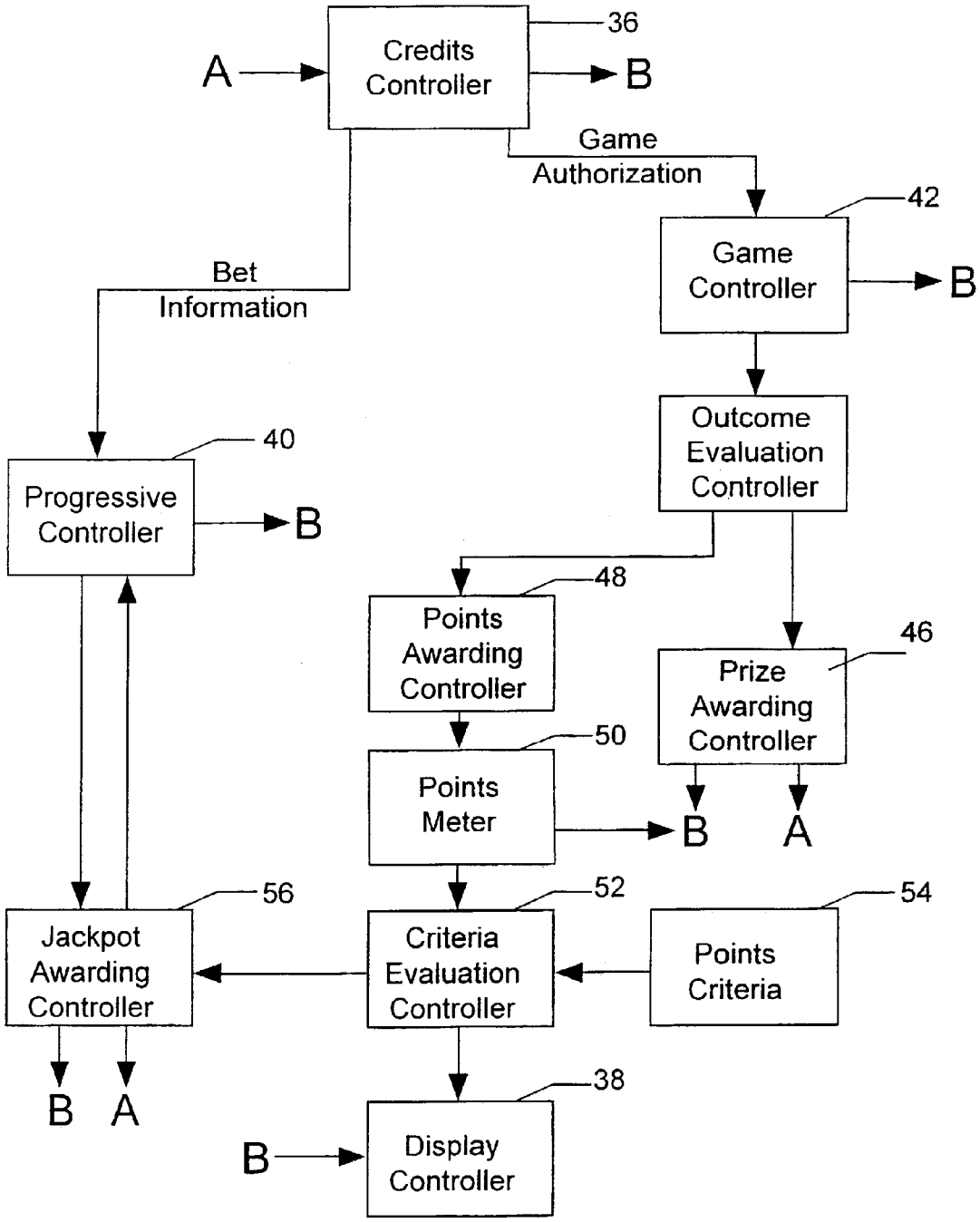
FIG. 3 is a block diagram illustrating an embodiment.

A block diagram, FIG. 3, shows the different processes each play of the game passes through. First, a credit controller 36 allows players to insert credits in the gaming device. The number of credits is continuously displayed 38 concurrently to the insertion of credits and the choice of a bet value by players. Afterwards, the information according to the bet is transmitted to the progressive controller 40, therefore increasing and displaying 38 the progressive jackpot value along with a predetermined percentage of the bet. Simultaneously, a game authorization is sent to the game controller 42, therefore allowing the play to begin. The play is then played, displayed by the display controller 38 until the final outcome. Then, the final outcome is evaluated 44 in regards to a regular prize to award 46 and in regards to points to award 48 to the player. Following to the evaluation of the outcome 44, the prize is awarded 46 to the player by the credit controller 36 also to be displayed 38 on the screen of the gaming device. Apart from the prize, the points awarded 48 in regards to the outcome increase the point meter 50. The number of points awarded is determined randomly according to the outcome. Accordingly, the new value of the point meter 50 is displayed 38 on the screen, always informing players where they are relatively to the nearest point criteria. Next, the value of the point meter 50 is evaluated 52 in regards to the matching of one of the point criteria 54.

If the point meter goes beyond one of the present point criteria displayed, a new point criterion replaces the previous point criterion, therefore always displaying 38 the nearest point criterion increasing the present value of the point meter 50. However, if the point meter value matches the displayed point criterion, the player wins the jackpot 56. The jackpot value is determined in regards to the progressive controller 40, itself decreasing its value in regards to the jackpot. Afterwards, the value of the jackpot won is displayed 38 on the screen of the gaming device as a prize won and added by the credit controller 36 to the credits of the player.

A second embodiment consists of taking a bank of predetermined numbers and associating a distinct bank to each point awarding event in the game. When a point awarding event occurs in the game, the Poker machine randomly picks a number from the corresponding bank. To have low probabilities of matching the aimed number of points, the bank having a high frequency of point awarding events awards relatively high points. Since exact numbers are more difficult to match with a series of high numbers than lower numbers, the difficulty of winning the jackpot is increased. Additionally, with this method, it is difficult and almost impossible for players to foresee a series of point awarding events they need to yield to match the aimed number of points permitting to win the jackpot.

For this embodiment, the display of the game on the screen of the gaming device is similar to the one of the first embodiment, see FIG. 1. The display comprises, additionally to the regular information of the Poker game 10, 12, 14, 16, information concerning winning the jackpot 18. However, even if the determination of the number of points 22 in the game is not similar, there is no new information displayed concerning the average value of each outcome, or similar information. The only information communicated to players regarding the points is in the help menu of the game wherein a short text informs that for each outcome, the number of points awarded varies from time to time. Also, it explains that outcomes having high prize value are generally associated with less points, and outcomes of lower value with more points.

Below, TABLE 3 shows a list of distinct number banks regarding different point awarding events in a Poker game. When one of these point awarding events occurs, a number is randomly picked from the corresponding bank and added in the meter. The value of the meter is displayed all the time, therefore permitting players to approximately foresee not the point awarding events but the number of games required to reach the aimed number of points allowing them to win the progressive jackpot.

TABLE 3

Bank of numbers associated with Poker outcomes

| Point awarding events | Bank of numbers |
|---|---|
| Pair | numbers 12 to 20 |
| 3 of a kind, 2 pairs | numbers 8 to 13 |
| Straight, flush | numbers 5 to 8 |
| Full house, 4 of a kind | numbers 3 to 6 |
| Straight flush, royal flush | numbers 1, 2, and 3 |

For example, if the final outcome of a Poker game is a straight, the game will pick a number from a range varying from between 8 and 13. If the number 12 is randomly selected, 12 points will increase the meter to produce a new meter value closer to the aimed number of points. However, if the above 12 points increases the meter value too high, therefore going beyond the criterion, players see the aimed number of points farther than before. In both cases, the numbers will continue to increase the meter value along with the games played.

Figure 4:
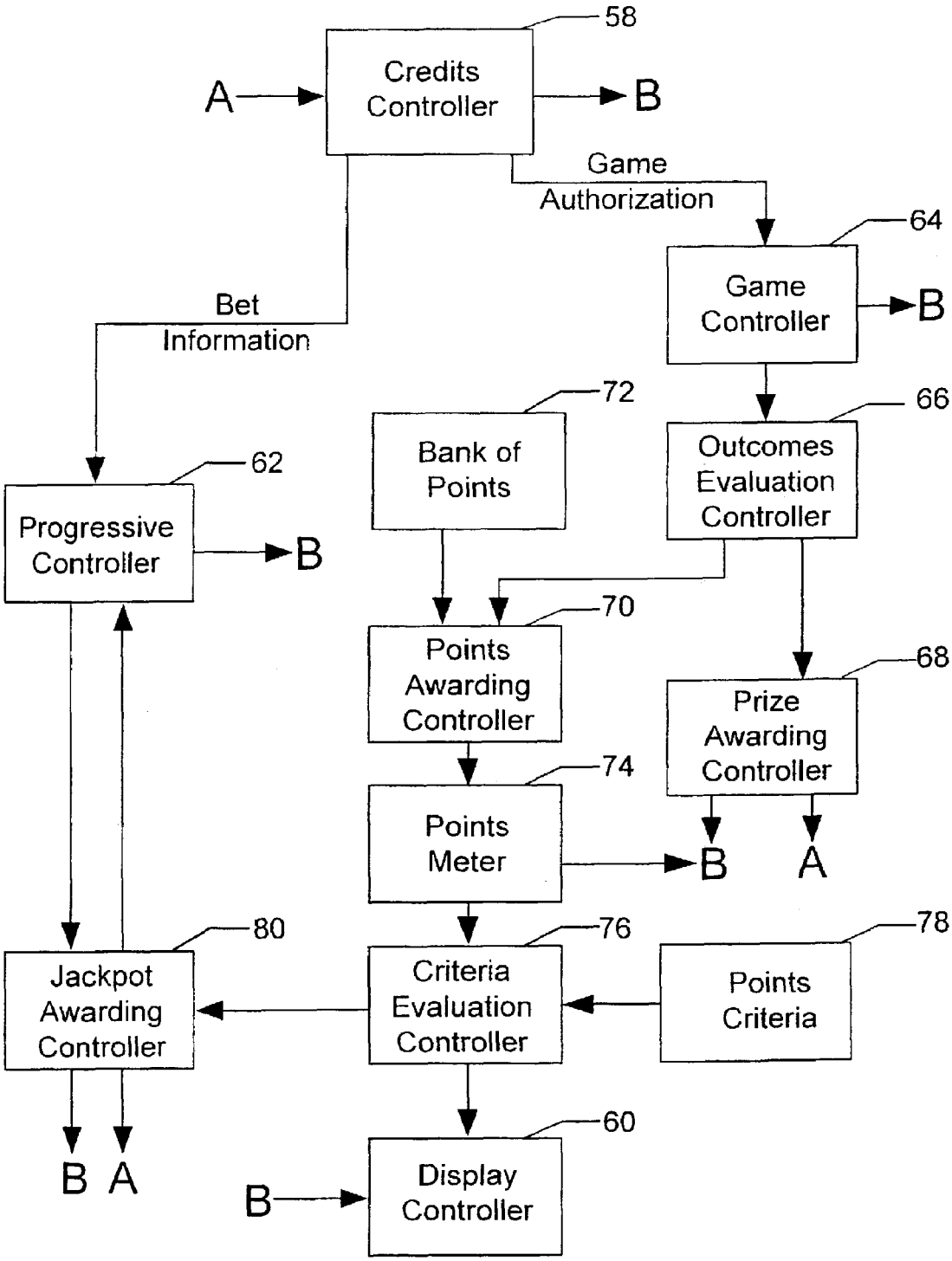
FIG. 4 is a block diagram illustrating another embodiment.

The block diagram presented in FIG. 4 shows the different processes of each play. First, a credit controller 58 allows players to insert credits in the gaming device. The number of credits is continuously displayed 60 concurrently to the insertion of credits and the choice of a bet value by players. Afterwards, the information according to the bet is transmitted to the progressive controller 62, therefore increasing and displaying the progressive jackpot value along with a predetermined percentage of the bet. Simultaneously, a game authorization is sent to the game controller 64, therefore allowing the play to begin. The play is then played, displayed by the display controller 60, until the final outcome. Then, the final outcome is evaluated 66 in regards to a regular prize to award 68 and in regards to points to award 70 to the player. Following the evaluation of the outcome, the prize is awarded 68 to the player by the credit controller 58 additionally to be displayed 60 on the screen of the gaming device. Besides the prize, the point awarding controller 70 determines in regards to the outcome which of the banks of points 72 is used. Afterwards, the point awarding controller 70 determines with a random process the point value increasing the point meter 74. Accordingly, the new value of the point meter 74 is displayed 60 on the screen, always informing players where they are relatively to the nearest one of the point criteria. Next, the value of the point meter is evaluated 76 in regards to matching one of the point criteria 78. If the point meter goes beyond one of the present point criteria displayed, a new point criterion replaces the previous point criterion, therefore always displaying the nearest point criterion increasing the present value of the point meter 74. However, if the point meter value matches 76 the displayed point criterion, the player wins the jackpot 80. The jackpot value is determined in regards to the progressive controller 62, itself decreasing its value in regards to the jackpot. Afterwards, the value of the jackpot won is displayed 60 on the screen of the gaming device as a prize won and added by the credit controller 58 to the credits of the player.

Additionally, the third embodiment consists of the same Poker machine as the above embodiments. For this one, each one of the regular winning outcomes is a point awarding event and is associated with fixed numbers of points. TABLE 4 shows in a detailed manner the numbers of points increasing the meter in regards to the final outcome of the Poker game. For simplicity, the same awarding schedule as TABLE 1 is used for this embodiment.

TABLE 4

List of points associated with different outcomes in a Poker game

| Outcomes | number of points |
|---|---|
| Pair | 7 points |
| 2 pairs | 6 points |
| 3 of a kind | 5 points |
| Straight | 4 points |
| Flush | 3 points |
| Full | 2 points |
| 4 of a kind | 1 points |
| Straight flush | 1 points |
| Royal flush | 1 point |

The example thereinafter gives more clarity to the application of this method on an electronic Poker game.

When a player places a bet in the electronic Poker machine and begins to play, the game follows the usual process towards a final hand. Afterwards, the final hand is evaluated, therefore determining the number of points increasing the meter to win the jackpot and the prize awarded in the game itself. If the new meter value does not match a multiple of 500 points, the player is ready to play a new game on the Poker game without having any other diversion. However, if the meter value matches a multiple of 500 points, the player is awarded the jackpot in addition to the regular prize.

As an example, a series of outcomes will be evaluated to clearly explain how the method works with this embodiment. TABLE 5 shows hypothetical outcomes and points increasing the meter value. For example, we will assume that before the first outcome, the meter value corresponds to 1462 points.

TABLE 5

List of results for the third embodiment

| Outcomes | Number of points | Number in the counter | Win jackpot? |
|---|---|---|---|
| . . . | . . . | 1474 points | No |
| Pair | 7 points | 1481 points | No |
| Loss | 0 point | 1481 points | No |
| 2 pairs | 6 points | 1487 points | No |
| 3 of a kind | 5 points | 1492 points | No |
| Loss | 0 point | 1492 points | No |
| Loss | 0 point | 1492 points | No |
| 4 of a kind | 1 points | 1493 points | No |
| Loss | 0 point | 1493 points | No |
| Pair | 7 points | 1500 points | Yes |

The probabilities of matching 1500 points with this embodiment are very low. Nevertheless, it seems possible to foresee the sequence of outcomes required to win the jackpot. However, because of the difficulty of obtaining other outcomes than pairs, 2 pairs or 3 of a kind, it is very hard. Furthermore, because of the fact that simple pairs are winning outcomes only when the cards composing the simple pairs are jacks or better ones, it is even more difficult. Luckily, in this example, the player succeeds to accumulate 1500 points. Consequently, the player wins a predetermined percentage of the value of the progressive jackpot. More precisely, the player is awarded 50% of the present and maximum value of the jackpot as showed in TABLE 1. Even if the player does not win the whole value of the jackpot, the player wins an important amount.

However, a point difficult to miss in the three above embodiments is the fact that accumulating a number of points going beyond an aimed number of points is very easy. Therefore, players who play games implemented with the present method of awarding jackpots see themselves multiple times going beyond the aimed number of points without matching it. Therefore, they see themselves having frequent possibilities of wins and therefore near misses. Nevertheless, they can not judge the game as being unfair, they win or miss the jackpot according to their plays.

Figure 5:
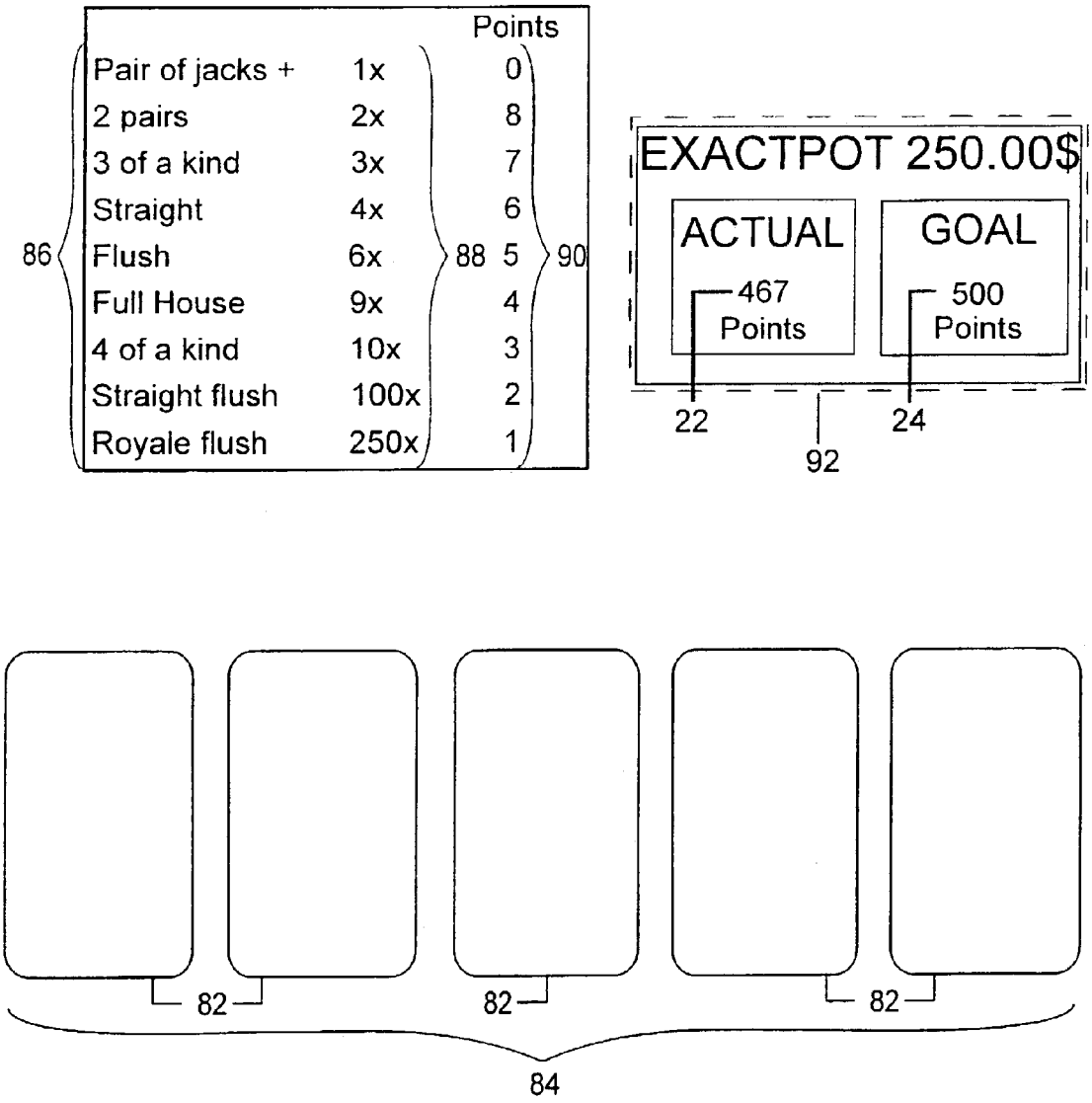
FIG. 5 is a play screen illustrating another embodiment.

With this embodiment, the display on the screen of the gaming device presents modifications in comparison to the two embodiments above. FIG. 5 presents a standard display with this embodiment. It shows a game interface for the major part perfectly similar to regular Poker game displays. It comprises the five (5) playing cards 82 composing the player's Poker hand 84, a list of the winning combinations 86 and the odds 88 determining the amount paid according to each winning combination 86. Additionally, it presents the number of points awarded 90 with each outcome 86, therefore players can continuously verify the outcomes to aim for to win the jackpot. It also comprises information 92 showing what players need to know in regards to winning the jackpots. The information 92 comprises in more details the jackpot value 94, the number of points accumulated 96 up to date corresponding to the meter value, and the number of points a player must match 98 to win the jackpot, i.e. the aimed number of points. The information 94, 96 and 98 are specific to awarding the jackpot and do not influence the rules of the game nor the value 88 of the different winning combinations 86. Furthermore, this information 94, 96 and 98 is constantly updated to assure that players have all the information required to make intelligent decisions in regards to winning the jackpot. However, even if additional information 92 is displayed on the screen, the information of the game itself still has all the visibility required. Therefore, it is clear what is the primary goal of the game: the Poker game.

The addition of a method of awarding jackpots such as the ones presented above will possibly produce slight modifications in players' strategies. One example of the modification is the possibility that players sometimes will prefer losing winning hands to increase the chances of winning the jackpot. However, the modification of playing strategies has positive effects on the game such as increasing the feeling of suspense in the game.

Figure 6:
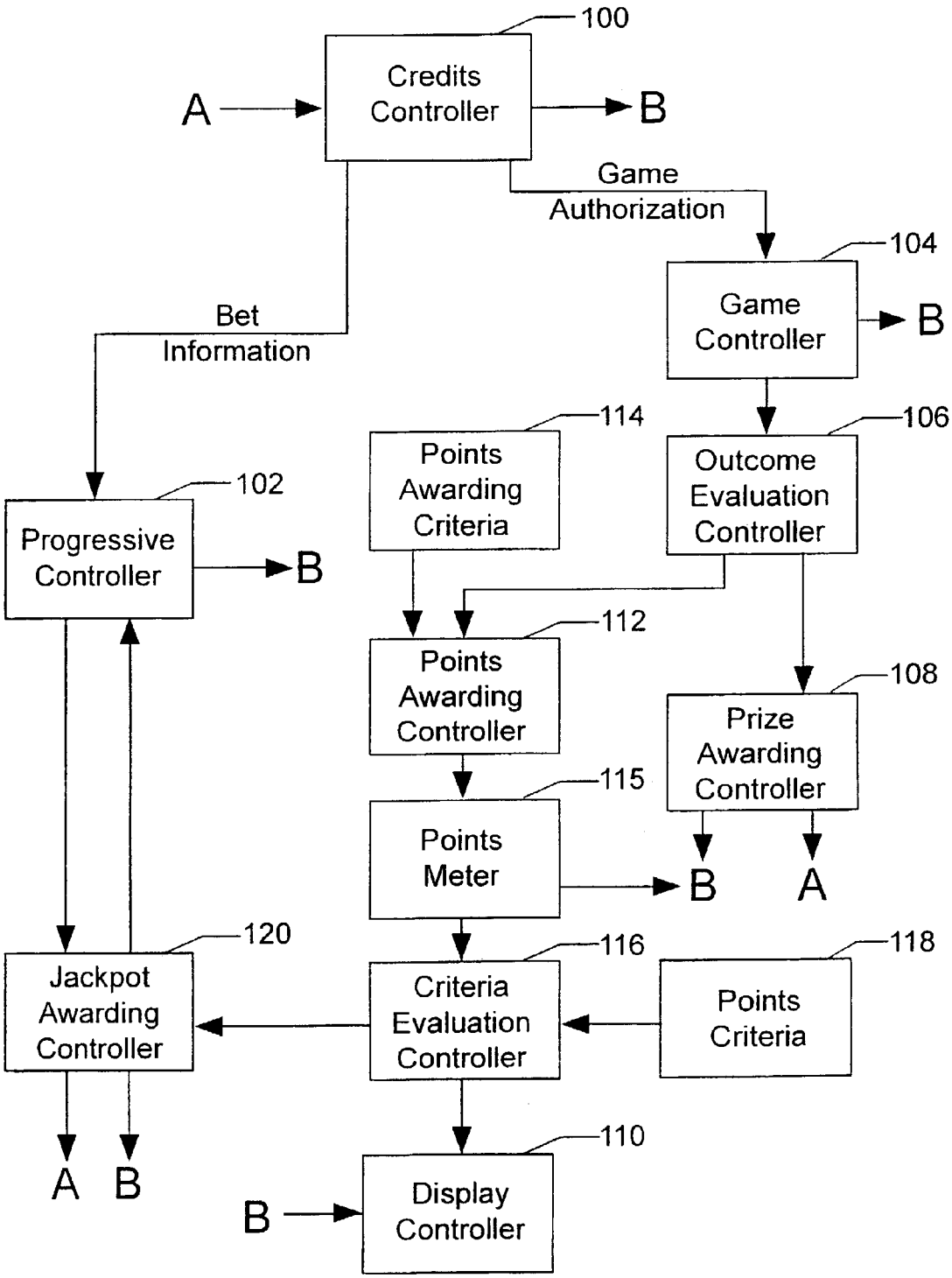
FIG. 6 is a block diagram illustrating another embodiment.

FIG. 6 presents a block diagram of this embodiment. First, the credit controller 100 allows players to insert credits in the gaming device. The number of credits is continuously displayed 110 concurrently to the insertion of credits and the choice of a bet value by players. Afterwards, the information regarding the bet is transmitted to the progressive controller 102, therefore increasing and displaying 110 the progressive jackpot value according to a predetermined percentage of the bet. Simultaneously, a game authorization is sent to the game controller 164, therefore allowing the play to begin. The game displayed by the display controller 110 is then played, to the final outcome. Then, the final outcome is evaluated 106 in regards to a regular prize to award 108 and in regards to points to award 112 to the player. Following the evaluation of the outcome, the prize is awarded 108 to the player by the credit controller 100 additionally to be displayed 110 on the screen of the gaming device. Besides the prize, the point awarding controller 112 determines in regards to both the outcome 106 and the point awarding criteria 114 the point value increasing the point meter 115. Accordingly, the new value of the point meter 115 is displayed 110 on the screen, always informing players where they are relatively to the nearest one of the point criteria. Next, the value of the point meter is evaluated 116 in view of matching one of the point criteria 118. If the point meter goes beyond one of the present point criteria displayed, a new point criterion replaces the previous point criterion, therefore always displaying the nearest point criterion increasing the present value of the point meter 115. However, if the point meter value matches the displayed point criterion, the player wins the jackpot 120. The jackpot value is determined in regards to the progressive controller 102, itself decreasing its value in regards to the jackpot. Afterwards, the value of the jackpot won is displayed 110 on the screen of the gaming device as a prize won and added by the credit controller 100 to the credits of the player.

A further addition to the above embodiments consists of having an additional feature to prevent players of foreseeing a sequence of outcomes required to win the progressive jackpot. One point is deducted from the meter when losses occur in the game. Furthermore, to totally remove the possibility of foreseeing sequences of outcomes, not all the losing games see the meter value decreasing. Therefore, to foresee a sequence of outcomes necessary to win the jackpot, players must avoid losses. This results in a progressive jackpot even more difficult to win. Some players can dislike the fact of losing points in regards to losses in the primary game. They can see that as double losses, therefore as a frustrating element in the game. However, if the frequency of these losses of points is low and the number of points lost is also low, players will not be really disturbed by that.

This addition does not involve changes to the block diagrams. It only results that one additional outcome, the losing outcome, is evaluated in awarding points in each play. Furthermore, the point awarding in regards to the plays decreases the point meter in addition to increasing it with other outcomes. However, it only represents new information in the banks of points of the second embodiment, and new point awarding criteria for the third one.

Furthermore, adding points with occurrence of winning outcomes and deducting points with losses produces an unstable meter value. Nevertheless, statistically, the number of points accumulated will always increase because of probabilities of each of the outcomes and the number of points associated with each one of these outcomes. Depending on a winning streak or a losing streak, the proportion of the losing games decreasing the meter value, the meter value can increase fast or decrease below a previously overshot aimed number of points. Nevertheless, once the meter goes beyond a criterion, the criterion is replaced by the new higher criterion. Thus, it is not possible for players to voluntarily decrease the meter value to have a second chance to win the jackpot with the same previously overshot criterion.

TABLE 6 shows an example of a losing streak with this security process on the meter value. To keep it simple, the schedule of criteria defined in TABLE 1 is used with this embodiment. Furthermore, to keep it even simpler, every losing game decreases the meter value. To determine the increment of the meter when a winning outcome occurs, number of points in TABLE 4 is used.

TABLE 6

Example of outcomes and corresponding counter value

| Outcomes | Number of points | Number in the counter | Win jackpot? |
|---|---|---|---|
| . . . | . . . | 1487 points | No |
| Pair | 7 points | 1494 points | No |
| Loss | −1 point | 1493 points | No |
| 2 pairs | 6 points | 1499 points | No |
| Full house | 2 points | 1501 points | No, criterion: 2000 |
| Loss | no points | 1501 points | No |
| Loss | −1 point | 1500 points | No |
| 4 of a kind | 1 point | 1501 points | No |

Additionally, a fourth embodiment consists of having only part of the winning outcomes as point awarding events. It further consists of determining the number of points awarded not only in regards to the point awarding event but also in regards to the elements composing the point awarding event. More precisely, players are awarded points when they yield one of particular point awarding events. However, this number of points depends on the cards composing the final hand. In its preferred way, it is necessary to yield a Poker hand comprising at least three (3) cards of the same value such as a "Three of a kind" poker hand. Hereafter, the number of points awarded corresponds to the value of the three (3) cards having the same value. For example, a hypothetic Poker hand comprising three (3) eights (8's), a king and a jack awards player eight (8) points. Additionally, all the hands composed of at least three (3) cards of same value are point awarding events. Therefore, "Three of a kind", "Full house", and "Four of a kind" are point awarding events. However, even if the other hands are winning hands, even if some of them have a greater value than these point awarding events, they do not award points to players. Therefore, players do not only have to yield specific Poker hands to win the jackpot, but they have to yield it with particular cards having a value corresponding to the number of points required to match the aimed number of points. Consequently, players will find very hard to match it even if they know exactly what is required to win.

Figure 7:
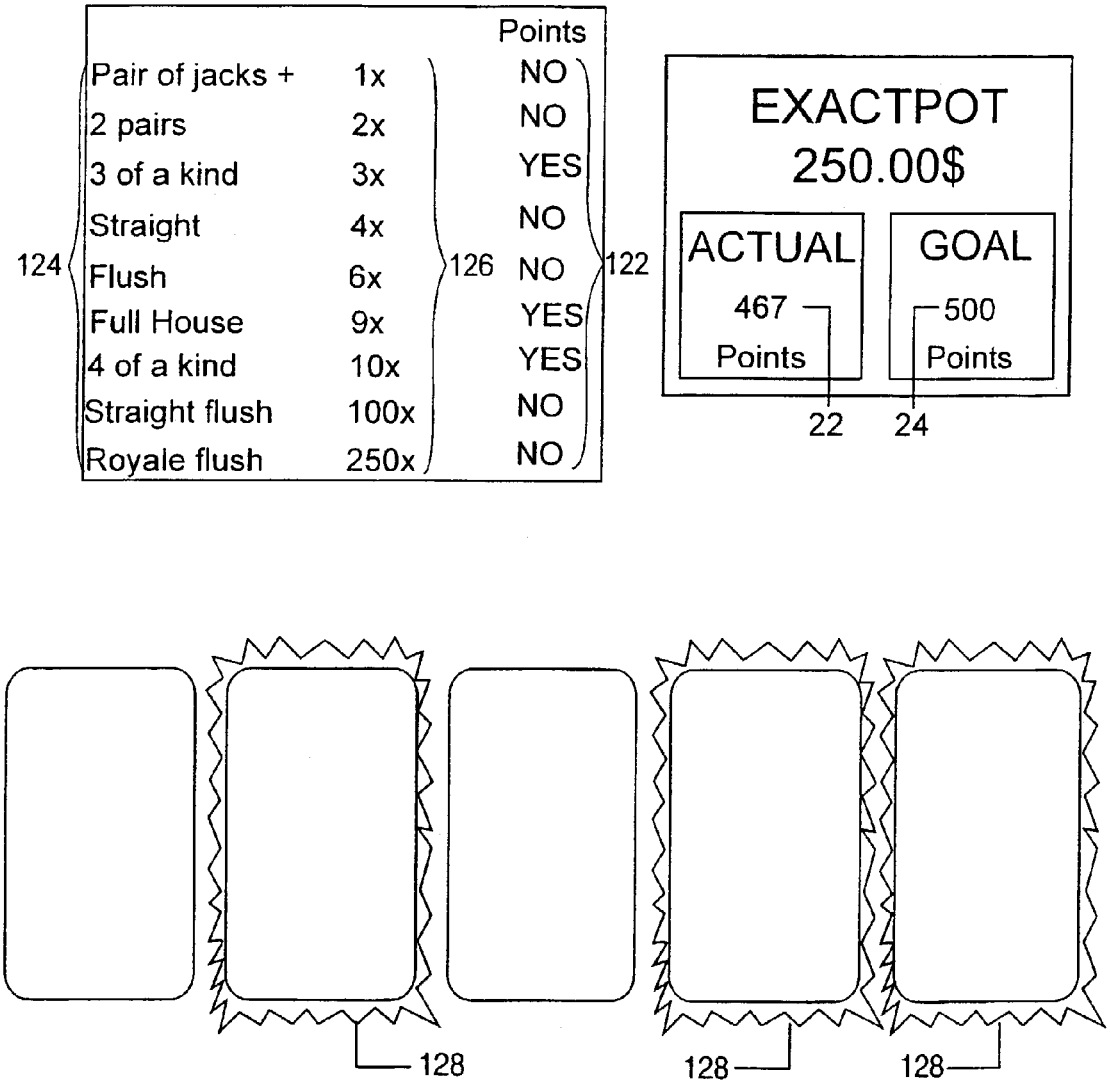
FIG. 7 is another play screen according to the relevant embodiment.

The screen display of FIG. 7 presents the modification to the game display in regards to this method of determining the points. This screen display shows the same information as the third embodiment in FIG. 5. The only difference is the number of points displayed beside the odds on the screen. These numbers are not displayed, the only thing displayed is a flag-type information 122 informing the player if the corresponding outcome 124 gives points. In this example, the flag-type information 122 is only a "yes" displayed beside the odds 126 for the outcomes 124 comprising three identical cards. Furthermore, during the evaluation of the outcomes, the cards presenting the same value and allowing the player to be awarded a number of points corresponding to the value of these cards are highlighted 128. Therefore, it is easy to follow the evolution of the points and the point awarding criteria.

The block diagram for this embodiment is exactly the same as for the previous embodiment, see FIG. 6. The difference between these two embodiments is in the point awarding criteria in regards to the final outcome of each play.

To balance out the payout of the jackpot for all the different bets players can place as well as to increase the interest of players to place more important bets, a technique used consists of awarding more points for the jackpot when the bet placed in the game is higher. Consequently, players will place high bets to increase the meter faster when they are far from the active criterion. However, when they are near the criterion, they will reduce their bets to increase their chances of matching the criterion. Like described above, the higher the points are, more difficult is to match a criterion. And, on the contrary, the lower the points are, the less difficult it is for a player to match a criterion. An extreme example is that you can not go beyond a criterion without matching it while being awarded just one point at a time.

Furthermore, to offer something similar to other games that require a minimum bet to win the jackpot, a possible process is to award points to players only when the bet placed is higher than a minimum bet. This way, it encourages to bet higher.

A fifth embodiment consists of a similar electronic Poker machine wherein two kinds of points increase the meter: win points and no-win points. A first kind of point awarding events awards win-points. These win-points can lead to winning the jackpot. A second kind of point awarding events awards no-win points. The no-win points are useful in increasing the meter value faster and to come close to the aimed number of points to win the jackpot. However, the no-win points are not efficient to win the jackpot by themselves. Matching the aimed number of points with no-win points does not allow players to win the jackpot.

In practice, along with the final outcomes in the game, players see the meter value increasing with a combination of win points and no-win points. However, when the meter value comes close to the aimed number of points, the last points increasing the meter value and resulting that the meter value matches the aimed number of points must be win-points, or else the jackpot is not awarded.

Furthermore, the number of points awarded to increase the value of the meter is not only defined by the class of the final outcome following the rules of Poker but also by the cards composing this final outcome. TABLE 7 shows the criteria used to determine the number of win points and no-win points in regards to the different elements composing the outcomes in a Poker game.

TABLE 7

Outcome criteria to award win points and no-win points.

| Win points outcomes | Win points |
|---|---|
| "Three of a kind" | number of points corresponding to a card composing the 3 of a kind |
| "Four of a kind" | number of points corresponding to a card composing the 4 of a kind |
| "Two pairs" | number of points corresponding to the sum of a card composing the first pair and a card composing the second pair |
| Example: | A hand with 3 eights gives 8 win points |
| **No-win points outcomes** | **No-win points** |
| "Pair" | number of no-win points corresponding to a card composing the pair |
| Example: | A hand with 2 fives gives 5 no-win points |

With the same criteria schedule to win the progressive jackpot as the one showed in TABLE 1, players could win big jackpots that have low probability of occurring.

Figure 8:
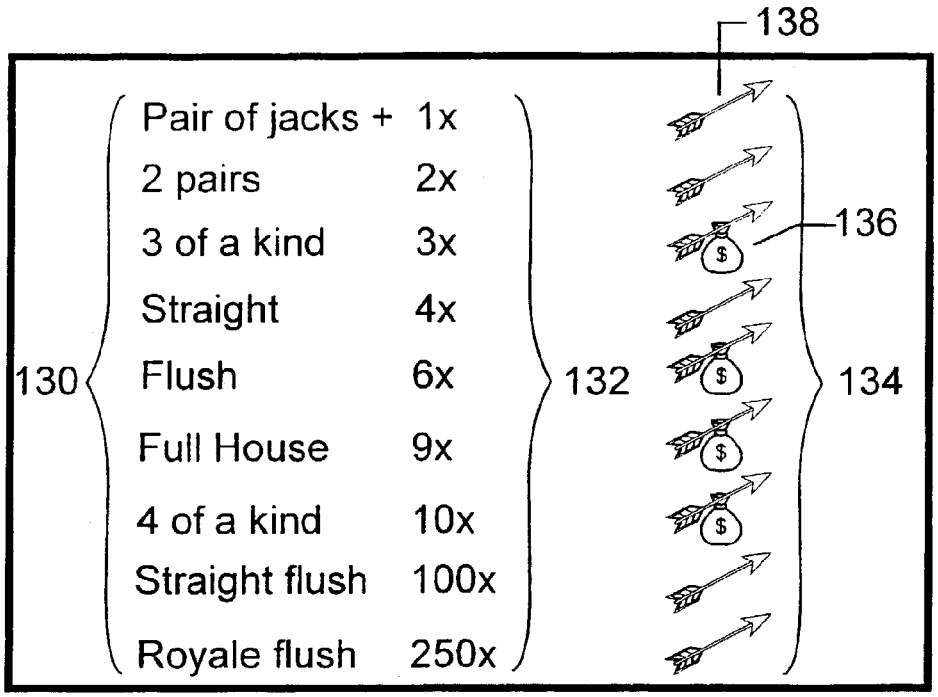
FIG. 8 is a partial play screen according to the relevant embodiment.

The game display for this game is exactly the same as the one for the previous embodiment, see FIG. 7. The difference is in the flag-type information. FIG. 8 presents a partial view of a game display for this embodiment. This partial view shows the information concerning the outcomes 130, the prize value 132 in regards to the outcomes 130, and the kind of points 134 awarded in regards to the outcomes. Not only having one kind of flag, this embodiment presents two (2) kinds of flags: one for the outcomes having win points 136, and the other for outcomes having no-win points 138. The preferred way to express these two flags are to use an arrow aiming up 138 for the no-wins points because of the fact that the no-win points increase the point meter without being efficient to win the jackpot. The win points are also represented as an arrow, however this arrow piercing a bag of money 136. This way, players can see that no-win points are useful to increase the point meter but not for winning the jackpot.

Figure 9:
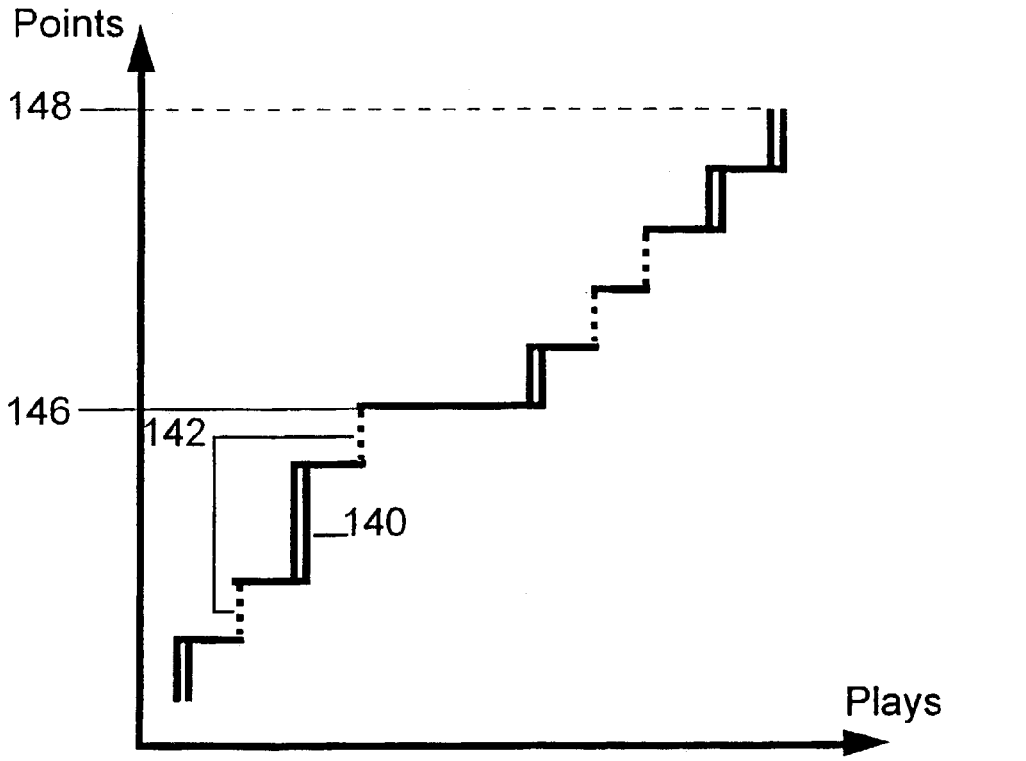
FIG. 9 is a schematic graphic showing the evolution of points according to another embodiment.

FIG. 9 presents in a graphical way the evolution of the number of points along with the plays in the game. Moreover, the graphic presents the evolution of the number of points in detail in regards to the win points and no win-points according to the criterion aimed. The win points awarded are represented as double vertical lines 140, the no-win points are represented as dotted lines 142.

Furthermore, the graph shows that the player matches the criterion 144 with no-win points 142. It results in the jackpot not being awarded to the player. Even if the player matches the criterion 144, the last points awarded must be win points 140 to win the jackpot. Therefore, the players sees the active criterion 146 to aim to win the jackpot become a new one 148. Moreover, the players will need to match the criterion with last points being win points to win the jackpot, Or Else, they will miss the jackpot again.

This last embodiment gives motivation of obtaining interesting outcomes when the meter value is close to an aimed number of points. Nevertheless, players do not see the difference between win and no-win points when far from an aimed number of points. Along with the plays, the meter value increases in regards to numerous outcomes, without being influenced by the kind of points added to the meter. Therefore, players see the meter value increasing and can concentrate particularly on each individual outcome in each play. However, when the meter value comes close to the aimed number of points, it is important for players to select the best cards to have better chances of obtaining win-points and particularly avoiding no-win points that would cause the meter value to go beyond the aimed number of points. Consequently, the player's skills are seriously challenged by this method of awarding a progressive jackpot. However, it is not impossible for players having skill, luck, or a good combination of both, to win the progressive jackpot.

An additional advantage of the above embodiment is to never remove points from players. Removing points from the meter value can have a repulsive effect on some players. It can discourage some players without having this effect on others. However, with positive points associated with all the point awarding events, the effect on players is always motivating; they see the meter value always increasing, therefore coming closer to the aimed number of points with each positive outcome. For example, TABLE 8 shows a hypothetical sequence of outcomes and their effects on the meter value in regards to the last embodiment. For that example, the criteria schedule of TABLE 1 is used. For a concise demand, the outcomes corresponding to "Three of a kind" are noted "3K" and "Four of a kind" are "4K", "Two pairs" are noted "2P", and the "Pairs" are noted as usual, all followed by the card values composing the outcome.

TABLE 8

Outcomes and counter values in regards to the outcomes

| Outcome | Points gathered | Points accumulated | Jackpot won |
|---|---|---|---|
| . . . | . . . | 1476 points | no |
| Pair of 2 | 2 no-win points | 1478 points | no |
| Loss | 0 points | 1478 points | no |
| 3K of 10 | 10 win points | 1488 points | no |
| Straight | 0 points | 1488 points | no |
| 4K of 6 | 6 win points | 1494 points | no |
| Pair of 6 | 6 no-win points | 1500 points | no |

As can be seen in TABLE 8, the Pair of six (6's) increases the meter to a value of 1500 points, number of points corresponding exactly to the number of points to win the progressive jackpot in TABLE 1. Nevertheless, the player does not win the progressive jackpot. The reason is that in the last play, the last points increasing the meter were no-win points. Therefore, as explained above, no-win points are not effective to win the progressive jackpot. It results that the player has lost his/her chance to win the progressive jackpot with this criterion. Another five hundred (500) points will be necessary to have a new chance to win the jackpot.

Additionally, in another embodiment, the method also allows to implement networks of electronic gaming devices. This consists of awarding points to players in regards to their plays and incrementing the points in a unique meter common for all players. Furthermore, by incrementing a unique meter, players play and accumulate points together to win the same jackpot. Furthermore, they do not only play together but also against each other by trying to be the first to match the aimed number of points and therefore win the jackpot. Additionally, by sharing the meter, players continually help each other by increasing the meter value faster, and eliminate others' chances of winning when they are close to winning the jackpot by increasing the meter value and going over the aimed number of points. Consequently, it creates a kind of help-competition relation between players that increases the feeling of suspense of the game. It creates a game with different attracting features for players without departing from the essential method of the present invention.

Figure 10:
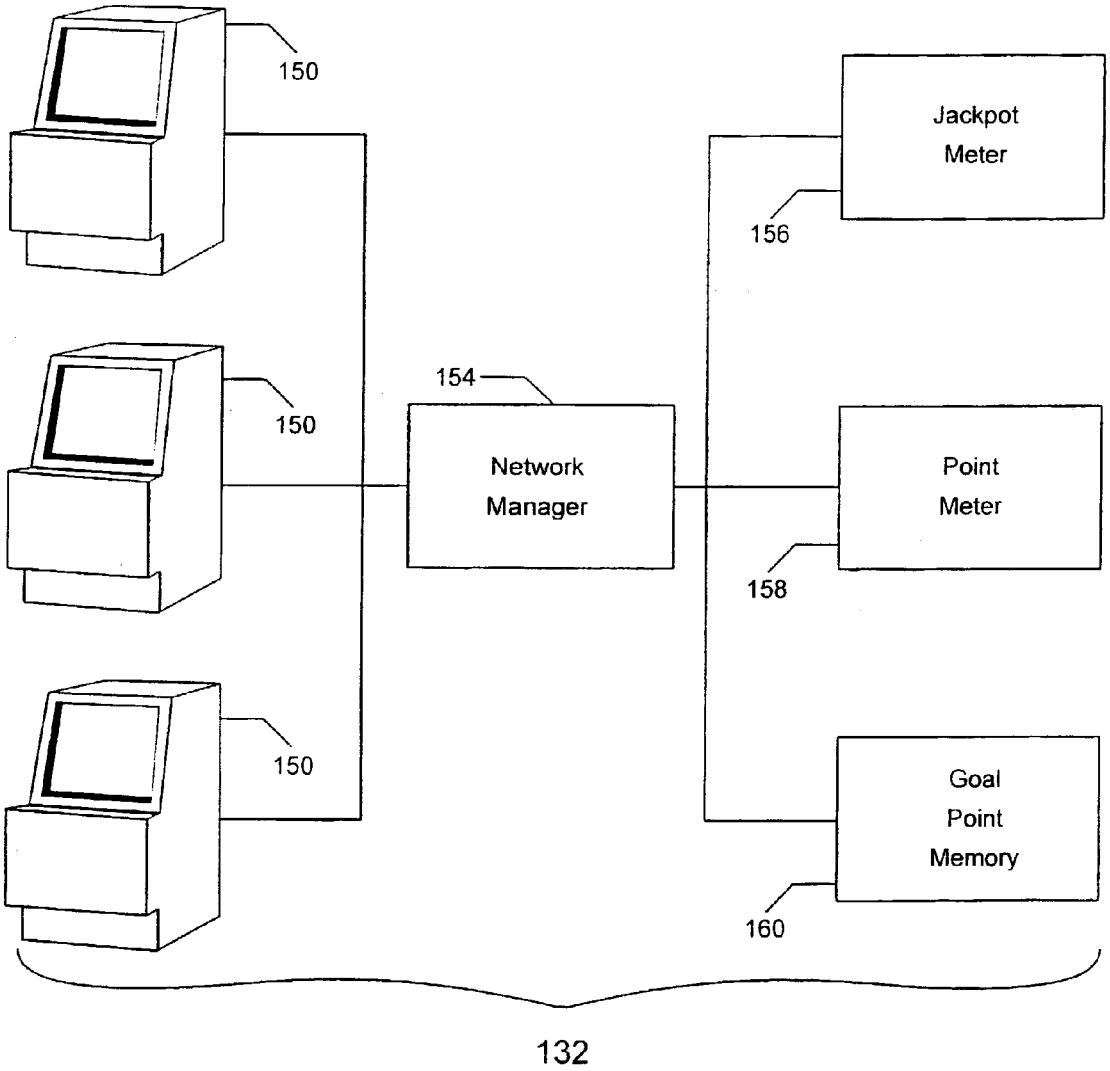
FIG. 10 is a schematic illustration of the environment of play according to the relevant embodiment.

FIG. 10 presents in a schematic representation the game environment of the sixth embodiment. Particularly, it comprises numerous electronic gaming devices 150 linked by a same network 152. A network manager 154 has the dedicated task of managing the information of all the electronic gaming devices 150 in regards to the present method of awarding jackpots. First, the network manager 154 increments a jackpot meter 156 of a predetermined percentage of the bet each time a new bet is placed on a Poker game on one of the electronic gaming devices 150. The network manager 154 also increments the point meter 158 each time points are awarded on one of the electronic gaming devices 150. Afterwards, it compares the point meter 158 value to the aimed number of points contained in the aimed point memory 160 after each addition to the point meter 158. When the point meter 158 value matches the aimed number of points, the jackpot is awarded in regards to the jackpot meter 156 value. Then, the jackpot value is awarded on the electronic gaming device 150 that yielded the final points needed to match the aimed number of points and credited the jackpot to the player 150.

The block diagram corresponding to the sixth embodiment is presented in FIG. 6. First, the credit controller 100 allows players to insert credits in the gaming device they are playing on. The credits are accumulated in their own gaming device for future plays. Moreover, the number of credits is continuously displayed 110 on their own gaming device concurrently to the insertion of credits and the choice of a bet value from players. Afterwards, for each gaming device, the information according to the bet is transmitted to a central progressive controller 102 located in the network, therefore increasing and displaying 110 a common progressive jackpot value along with a predetermined percentage of the bets by all the players. Simultaneously, a game authorization is sent to the game controller 104 of the gaming device, therefore allowing the player having placed bets to play. The game displayed by the display controller 110, is then played to the final outcome. Then, the final outcome is evaluated 106 in regards to a regular prize to award 108 and in regards to points to award 112 to the player. Following the evaluation of the outcome 106, the prize is awarded 108 to the player by the credit controller 112 additionally to be displayed 110 on the screen of the gaming device. In addition to the prize, the point awarding controller 112 determines in regards to both the outcome 106 and the point awarding criteria 114 the point value increasing a common point meter 115. Accordingly, the new value of the common point meter 115 is displayed 110 on the screen of all the gaming devices of the network displaying the game, always informing players where the meter value is relatively near from nearest one of the point criteria. Next, the value of the common point meter is evaluated 116 in regards to the matching of one of the criteria 118. If the point meter goes beyond one of the present displayed criteria, a new point criterion replaces the previous point criterion on each of the gaming devices, therefore always displaying the nearest point criterion increasing the present value of the common point meter 115. However, if the point meter value matches the displayed point criterion, the player that succeeds to match the criterion wins the jackpot 120. The jackpot value is determined in regards to the common progressive controller 102, itself decreasing its value in regards to the jackpot. Afterwards, the value of the jackpot won is displayed 110 on the screen of the gaming device of the winner as a prize won and added by the credit controller 100 to the credits of the lucky player.

Applications of the methods explained in the above embodiments are not limited to electronic Poker machines. The method of awarding jackpots of the present invention can be applied with live casino games with electronic meters to record the number of points accumulated by players. As well as other games applicable on electronic devices such as Craps, Blackjack, slot machines, etc wherein criteria regarding the different outcomes and the number of points can be defined and can be implemented with the present method of awarding jackpots. The criteria and method of counting the points presented above have been presented with the example of a Poker game for explicative purposes with no limitation in regards to their future use.

Figure 11:
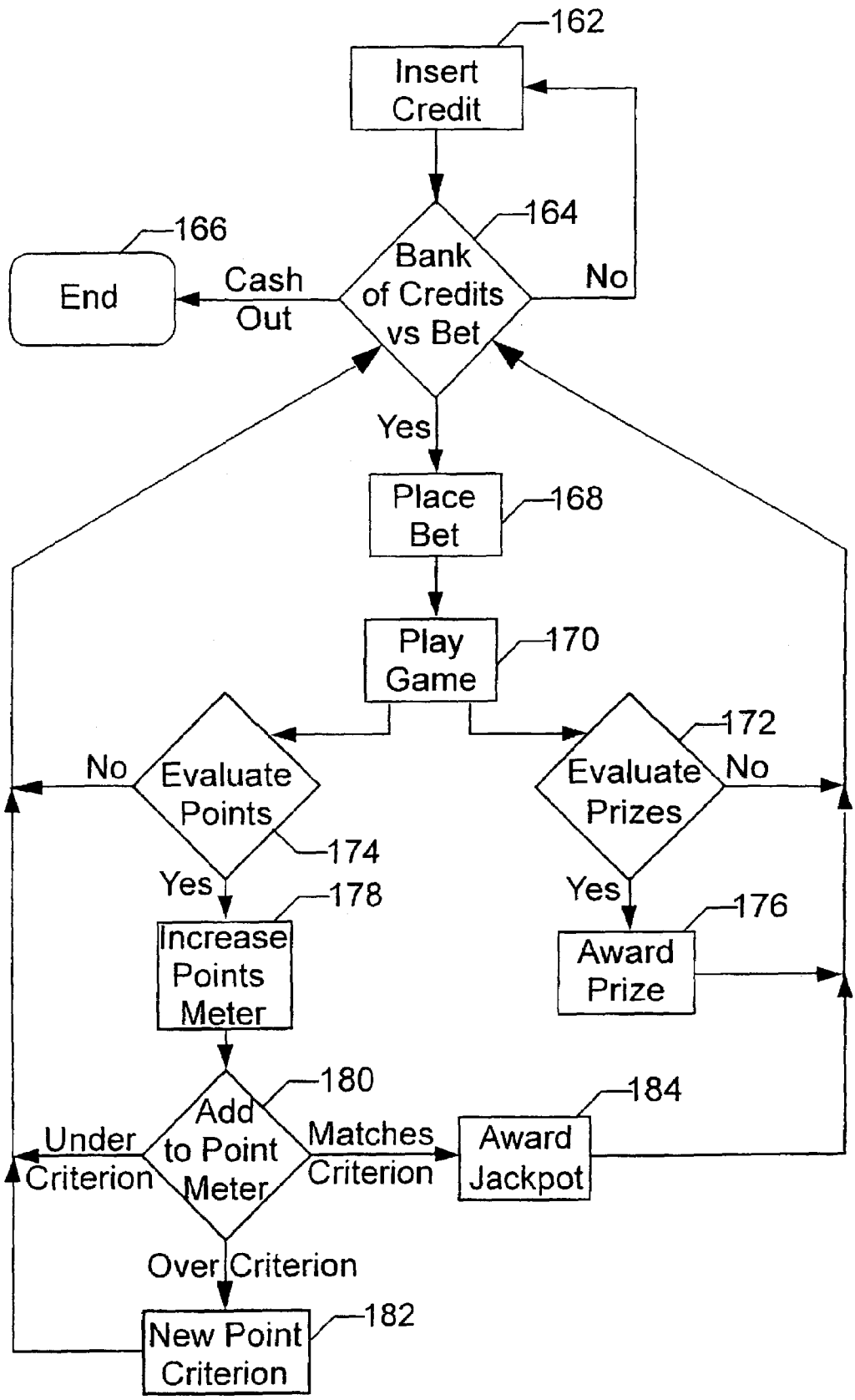
FIG. 11 is a flow chart presenting the different steps of playing a Poker game according to the corresponding embodiment.

Overall, the process of playing a Poker game is common for all the above embodiments and is explained in detail in the flow chart of FIG. 11. First, a player inserts credits 162 in the gaming device for further use to bet on the game. Afterwards, depending if the number of credits in the device is enough for the bet 164, or if the player wants to, he adds new credits. At any time before placing the bet, the player can cash out the credits 166 from the device. Once the bet placed 168, the player plays a play of that game 170 to its final outcome. Afterwards, two parallel processes take place: the evaluation of the outcome in regards to a prize won 172, and the evaluation of the outcome in regards to points required for the jackpot 174. With the process in regards to the prize 172, the outcome is evaluated to know if it corresponds to a predetermined winning outcome. If the answer is no, the player is ready to place a new bet 164. If the answer is yes, the player is awarded the corresponding prize 176 in regards to the bet placed at the beginning of the game. Concurrently, if there are no points to add to the meter, the game is ready to go back to displaying a new play 164. Or Else, the points increase the meter value 178, that is further evaluated in regards to the active criterion at that time 180. If the meter value is still under the criterion, the player is ready to place a new bet 164. Or Else, if the meter value goes beyond the criterion, the criterion is replaced by a new criterion 182 higher than the present one. Therefore, the active criterion can always be matched be increase the meter value. However, if the meter value matches the criterion, the player is awarded the jackpot 184 and it goes into the bank of credits of the player. Then the player can cash out his credits or continue to play by placing a new bet.

In the cases of the other embodiments, the principal differences with the block diagram and the flow chart presented here are the criteria used to award points to players in addition to the fact that players can see their point meter value decrease from time to time with some of the embodiments above. However, the basis of the above block diagram and flow charts are the same.

While the invention has been described in connection with specific embodiments thereof, it will be understood that it is capable of further modifications and this application is intended to cover any variations, uses, or adaptations of the invention following, in general, the principles of the invention and including such departures from the present disclosure as come within known or customary practice within the art to which the invention pertains and as may be applied to the essential features herein before set forth, and follows in the scope of the appended claims.

The invention claimed is:

1. A method of awarding a special prize along with the play of a game of chance, said method comprising the steps of:

determining a current special prize winning match value;

providing a special prize meter for accumulating point values, said meter having a current special prize meter value;

upon generation of an outcome in said game of chance, evaluating said outcome according to criteria;

if said outcome comprises a point awarding event, awarding a point value randomly determined or corresponding to said point awarding event, and adding said point value to said special prize meter to determine a new special prize meter value; and comparing said new special prize meter value to said current special prize winning match value;

if said new special prize meter value matches or exceeds said special prize winning match value, determining a new special prize winning match value, higher than the current special prize winning match value, the new special prize winning match value replacing and henceforth being the current special prize winning match value; and upon occurrence of a match between said new special prize meter value and said current special prize winning match value, awarding said special prize to said player, wherein said special prize is not awarded if said new special prize meter value exceeds said current special prize winning match value.

2. The method of claim 1, wherein said special prize meter is shared by at least two players; point values awarded to all said players are added to said special prize meter; and said special prize is awarded to the player who added the point value that brought said special prize meter value to match said special prize winning match value.

3. The method of claim 1, wherein two categories of said point values are provided: win points and no-win points; wherein said special prize is not awarded if said match occurs after the addition of no-win points to said special prize meter.

4. The method of claim 1, wherein said point value awarded for the occurrence of said point awarding event may correspond to a negative value.

5. The method of claim 1, further comprising the step of displaying information regarding said special prize winning match value, said special prize meter value, and said point values.

6. The method of claim 1, wherein said point values have no monetary value.

7. The method of claim 1, wherein said special prize corresponds to a progressive prize, increasing along with wagers placed by said player.

8. The method of claim 1, wherein said game is a Poker game, and said point awarding events correspond to winning outcomes according to rules of said Poker game.

9. A method of awarding a special prize along with the play of a game of chance, said method comprising the steps of:

determining a current special prize winning match value;

providing a special prize meter for accumulating point values, said meter having a current special prize meter value;

upon generation of an outcome in said game of chance, evaluating said outcome according to criteria;

if said outcome comprises a point awarding event, awarding a point value randomly determined or corresponding to said point awarding event, and adding said point value to said special prize meter to determine a new special prize meter value; and comparing said new special prize meter value to said current special prize winning match value;

if said new special prize meter value exceeds said special prize winning match value, determining a new special prize winning match value, higher than the current special prize winning match value, the new special prize winning match value replacing and henceforth being the current special prize winning match value; and upon occurrence of a match between said new special prize meter value and said current special prize winning match value, awarding said special prize to said player, wherein said special prize is not awarded if said new special prize meter value exceeds said current special prize winning match value.

10. The method of claim 9, wherein the step of determining a new special prize winning match value occurs upon occurrence of a match between said special prize meter value and said special prize winning match value.

11. The method of claim 9, wherein said special prize meter is shared by at least two players; point values awarded to all said players are added to said special prize meter; and said special prize is awarded to the player who added the point value that brought said special prize meter value to match said special prize winning match value.

12. The method of claim 9, wherein two categories of said point values are provided: win points and no-win points; wherein said special prize is not awarded if said match occurs after the addition of no-win points to said special prize meter.

13. The method of claim 9, wherein said point value awarded for the occurrence of said point awarding event may correspond to a negative value.

14. The method of claim 9, further comprising the step of displaying information regarding said special prize winning match value, said special prize meter value, and said point values.

15. The method of claim 9, wherein said point values have no monetary value.

16. The method of claim 9, wherein said special prize corresponds to a progressive prize, increasing along with wagers placed by said player.

17. The method of claim 9, wherein said game is a Poker game, and said point awarding events correspond to winning outcomes according to rules of said Poker game.

* * * * *